US009592981B2

(12) United States Patent
Xie et al.

(10) Patent No.: US 9,592,981 B2
(45) Date of Patent: Mar. 14, 2017

(54) THICKNESS MEASUREMENT DEVICE FOR SHEET-TYPE MEDIUM

(71) Applicant: GRG Banking Equipment Co., Ltd., Guangzhou, Guangdong (CN)

(72) Inventors: Qi Xie, Guangzhou (CN); Wenqing Wu, Guangzhou (CN); Xing Hu, Guangzhou (CN); Tianrui Li, Guangzhou (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 0 days.

(21) Appl. No.: 14/759,291

(22) PCT Filed: Jul. 3, 2013

(86) PCT No.: PCT/CN2013/078727
§ 371 (c)(1),
(2) Date: Jul. 6, 2015

(87) PCT Pub. No.: WO2014/117473
PCT Pub. Date: Aug. 7, 2014

(65) Prior Publication Data

US 2015/0356806 A1 Dec. 10, 2015

(30) Foreign Application Priority Data

Jan. 29, 2013 (CN) ..... 2013 1 0035025

(51) Int. Cl.
*B65H 7/12* (2006.01)
*B65H 7/02* (2006.01)
(Continued)

(52) U.S. Cl.
CPC ..... *B65H 7/12* (2013.01); *B65H 5/062* (2013.01); *B65H 7/02* (2013.01); *G07D 7/164* (2013.01);
(Continued)

(58) Field of Classification Search
CPC .. G07D 7/164; B65H 7/12; B65H 2404/1521; B65H 2511/13;
(Continued)

(56) References Cited

U.S. PATENT DOCUMENTS 3,679,202 A * 7/1972 Rauffer ..... B65H 7/12 271/263
4,136,454 A * 1/1979 Jenkins ..... B07C 5/08 33/501.03
(Continued)

FOREIGN PATENT DOCUMENTS

CN 101673429 A 3/2010
CN 101790486 A 7/2010
(Continued)

OTHER PUBLICATIONS

International Search Report dated Nov. 7, 2013 from corresponding International Application No. PCT/CN2013/078727.
Extended European Search Report, dated Jan. 19, 2016, from corresponding European Application No. 138739818.8.
Written Opinion of the International Searching Authority, dated Nov. 7, 2013, from corresponding International Application No. PCT/CN2013/078727.

*Primary Examiner* — Jeremy R Severson
(74) *Attorney, Agent, or Firm* — Wolf, Greenfield & Sacks, P.C.

(57) ABSTRACT

A thickness measurement device for a sheet-type medium comprises: a fixing frame (1), used for installing and bearing the following parts and components; a reference shaft (2), having two ends installed on the fixing frame (1) through bearings, wherein a reference roller (21) is fixedly fitted on the reference shaft (2); a detection shaft (3), wherein at least one floating support frame (31) having one end capable of rotating freely around the detection shaft (3) is arranged on the detection shaft (3), and a detection roller (32) and a signal generator (33) are arranged on the floating support frame (31); an elastic pressing plate (4), for pressing against the floating support frame (31) to keep an approaching trend between the detection roller (32) and the reference roller
(Continued)

(21), wherein the elastic pressing plate (4) is composed of at least two elastic sheets; a signal sensor (5); and a data processing unit. By means of the device, system damping is provided through friction between the elastic sheets, an output signal impact peak value instantly caused by the fact that a front end of the sheet-type medium crushes into a floating support frame bearing and a power shaft meshing point at a certain speed is reduced, and the adjustment time of oscillation of an output signal is shortened.

2 Claims, 3 Drawing Sheets

(51) Int. Cl.
*G07D 7/16* (2016.01)
*B65H 5/06* (2006.01)

(52) U.S. Cl.
CPC .. *B65H 2402/5441* (2013.01); *B65H 2403/60* (2013.01); *B65H 2404/1321* (2013.01); *B65H 2404/1341* (2013.01); *B65H 2404/144* (2013.01); *B65H 2404/1521* (2013.01); *B65H 2511/13* (2013.01); *B65H 2511/224* (2013.01); *B65H 2511/31* (2013.01); *B65H 2553/61* (2013.01)

(58) Field of Classification Search
CPC ..... B65H 2402/544; B65H 2402/5441; B65H 2511/224; B65H 2404/1341; B65H 2404/144; B65H 2553/612
See application file for complete search history.

(56) References Cited

U.S. PATENT DOCUMENTS

| | | | | |
|---|---|---|---|---|
| 4,232,447 | A * | 11/1980 | Grunder | G01B 7/107 33/501.02 |
| 5,678,678 | A | 10/1997 | Brandt, Jr. et al. | |
| 2007/0170301 | A1 * | 7/2007 | Morello | B65H 16/106 242/557 |
| 2008/0189968 | A1 * | 8/2008 | Schletti | G01B 7/107 33/501.4 |
| 2012/0001383 | A1 * | 1/2012 | Herrmann | B65H 5/062 271/226 |
| 2012/0134726 | A1 * | 5/2012 | Tomatsu | B65H 5/062 399/361 |
| 2012/0137533 | A1 * | 6/2012 | Muranaka | B65H 7/02 33/833 |
| 2013/0200565 | A1 * | 8/2013 | Takenaka | B65H 5/062 271/273 |

FOREIGN PATENT DOCUMENTS

| | | | |
|---|---|---|---|
| CN | 102542659 | A | 7/2012 |
| CN | 102722933 | A | 10/2012 |
| CN | 102842166 | A | 12/2012 |
| CN | 103136842 | A | 6/2013 |
| EP | 2184242 | A1 | 5/2010 |
| JP | S6264901 | A | 3/1987 |
| JP | 2006264928 | A | 10/2006 |
| JP | 2008044739 | A | 2/2008 |
| JP | 2011184124 | A | 9/2011 |

* cited by examiner

THICKNESS MEASUREMENT DEVICE FOR SHEET-TYPE MEDIUM

CROSS-REFERENCE TO RELATED APPLICATIONS

This application is the national phase of International Application No. PCT/CN2013/078727, filed on Jul. 3, 2013, which claims the priority benefit of Chinese Patent Application No. 201310035025.0 titled "THICKNESS MEASUREMENT DEVICE FOR SHEET-TYPE MEDIUM", filed with the Chinese State Intellectual Property Office on Jan. 29, 2013, which applications are hereby incorporated by reference to the maximum extent allowable by law.

FIELD

This application relates to a device for detecting thickness, and in particular to a device for detecting the thickness of a sheet-type value document in a financial self-service apparatus.

BACKGROUND

In a financial self-service apparatus, for verifying sheet-type value documents (e.g., paper currencies) in a batch processing one by one, it is required to separate the stacked sheet-type value documents, and then perform identification to each separated sheet-type value document by means of image identification, thickness detection, magnetic information detection, etc., to ensure the authenticity of the sheet-type value document to be processed, wherein the thickness detection is indispensable in the whole detection. The thickness detection information can not only serve to determine authenticity of the sheet-type value document to be processed, but also serve to determine whether the sheet-type value document mechanically separated is one piece or not, i.e., whether the separated paper currency is actually double pieces, to ensure the accuracy of counting.

Currently, most of conventional thickness detection devices are based on principles of infrared detection, optical detection and eddy current detection. However, no matter which detection method is taken, there will be a problem that oscillation of the thickness detection component occurs at an instant when a front end of a banknote rushes into the thickness detection device at a certain speed, and as reflected in a detection signal, the problem results in a peak at an initial part of the output signal and causes attenuation of the oscillation of the signal, and the attenuation time is prolonged as the rushing speed of the banknote increases (the impact is intensified). As reflected in the detection result, the problem results in that the thickness of a long area at the front end of the banknote cannot be detected effectively, and the faster the banknote runs, the larger the area at the front end of the banknote is neglected, which provides an opportunity for a counterfeit banknote to evade from the detection of the banknote identification device. Aiming at this technical issue, Chinese Patent CN101790486A discloses a device for detecting the thickness of paper which includes a reference roller, a detection roller, a detection block, a retaining block, a pressing component, a fluctuation suppressing component, and a displacement detecting component. The reference roller is arranged on a fixed rotary shaft and is a reference for determining thickness; the detection roller is arranged to be in contraposition with the reference roller and in contact with the reference roller; the detection block has one end provided with the detection roller and the other end is fixed and is freely rotatable about a support shaft, and displaces by rotatio in response to the thickness of the paper between the reference roller and the detection roller; the retaining block retains at least the support shaft of the detection block; and the pressing component, i.e., a metal leaf spring fixed on the retaining block, presses a portion of the detection block to maintain the closeness between the detection roller and the reference roller, and displaces according to the displacement by rotating of the detection block when the paper passes between the reference roller and the detection roller; the fluctuation suppressing component is configured to suppress the fluctuation of the detection roller by applying push through two ends of the support shaft; and the displacement detecting component is configured to detect the amount of displacement of the first pressing component in a non-contact manner. The device for detecting the thickness of paper is provided on the support shaft with multiple detection units composed of the detection roller, the detection block, the first pressing component, and the displacement detecting component. Though the above technical solution is capable of overcoming the problem caused by the impact, however, the impact is suppressed by the method of pushing axially to increase friction force of the detection component according to the above technical solution, which is apt to cause unsmooth movement of the detection component, and even results in failure of detection because the detection component fails to reset effectively or to reset timely. Also, precision of the machine construction will directly affect the result, and the difficulties encountered in manufacturing are great.

SUMMARY

An object of the present application is to provide a simple and reliable magnetic type device for detecting the thickness of a sheet-type medium, which has simplified components and is of an entirely changed magnetic type.

The device for detecting the thickness of a sheet-type medium includes: a fixing frame configured to support and install the following components; a reference shaft having two ends installed onto the fixing frame through bearings, and receiving a power as an input power source for a sheet-type medium, with a reference roller being fixedly fitted on the reference shaft; a detection shaft having two ends fixedly installed onto the fixing frame, the detection shaft being provided thereon with at least one floating support frame which has one end capable of rotating freely about the detection shaft, and a detection roller being freely rotatable and provided at a free end of the floating support frame, and a signal generator being fixedly provided at the free end of the floating support frame on a side opposite to the detection roller, with the detection roller being arranged in elastic contact with the reference roller; an elastic pressing plate having one end fixed to the fixing frame and the other end forming a free end and applying a pressing force to the floating support frame in a direction towards the reference roller; and a signal inductor arranged on the floating support frame and corresponding to the signal generator, wherein the elastic pressing plate is composed of at least stacked two elastic sheets and the elastic sheets have one ends relatively fixed and the other end forming a freely stacked state.

Preferably, the floating support frame is further provided with a dust scraper thereon, a free end of the dust scraper scrapes against a surface of the detection roller to scrape dusts accumulated on the surface of the detection roller during rotation of the detection roller.

Preferably, the number of the floating support frames is twelve groups.

Preferably, the elastic pressing plate is a strip-shaped elastic plate, and twelve elastic pressing bars corresponding to the floating support frames are extended from the elastic plate.

The device for detecting the thickness of a sheet-type medium has the following advantageous compared with those in the conventional technology.

A system damping is provided by the friction between the elastic sheets, thereby reducing the impact peak value of the output signal caused at the instant when the front end of the sheet-type medium rushes at a certain speed to a meshing point of floating support frame bearing and a power shaft, and shortening the time for regulating the oscillation of the output signal.

DETAILED DESCRIPTION OF THE EMBODIMENTS

For further explaining the device for detecting the thickness of a sheet-type medium according to the present application, further description is made in detail hereinafter in conjunction with an illustration of a preferred embodiment of the present application.

Figure 1:
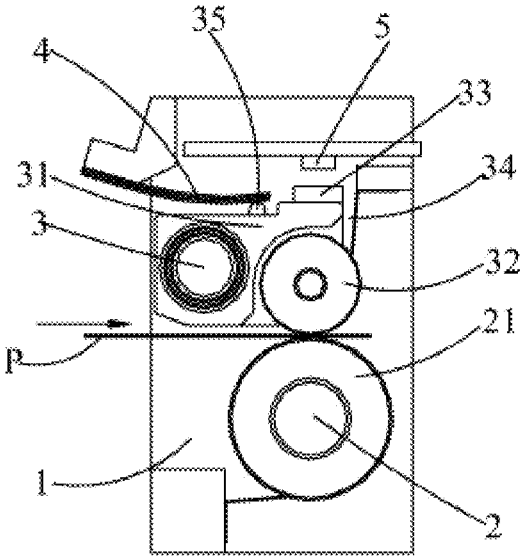
FIG. 1 is a schematic diagram showing the composition of a preferred device for detecting the thickness of a sheet-type medium according to the present application.
Figure 2:
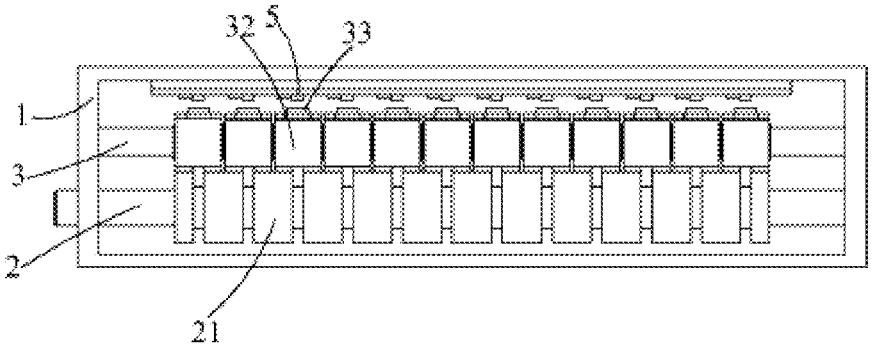
FIG. 2 is a front view of the device for detecting the thickness of a sheet-type medium as shown in FIG. 1.

Reference is made to FIGS. 1 and 2, a preferred device for detecting the thickness of a sheet-type medium according to the present application includes: a fixing frame 1 configured to install and bear the following components; a reference shaft 2 having two ends installed onto the fixing frame 1 through bearings, with a reference roller 21 being fixedly fitted on the reference shaft 2; a detection shaft 3 having two ends fixedly installed onto the fixing frame 1, and the detection shaft 3 being provided thereon with at least one floating support frame 31 which has one end capable of rotating freely about the detection shaft 3, and a detection roller 32 being freely rotatable and provided at a free end of the floating support frame 31, and a signal generator 33 being fixedly provided at the free end of the floating support frame 31 on a side opposite to the detection roller 32, with the detection roller 32 being arranged in elastic contact with the reference roller 21; an elastic pressing plate 4 having one end fixed to the fixing frame 1 and the other end forming a free end and applying a pressing force to the floating support frame 31 in a direction towards the reference roller 21, to keep an approaching trend between the detection roller 32 and the reference roller 21, specifically, an arcuate contact block 35 being provided on the floating support frame at a position corresponding to where the elastic pressing plate 4 is contacted, the elastic pressing plate 4 composed of stacked three pieces of elastic sheets, with one end of the elastic sheets relatively fixed, and the other end forming a freely stacked state; and a signal inductor 5 arranged on the floating support frame 31 and corresponding to the signal generator 33, the signal inductor 5 is electrically coupled with a data process unit (not shown in drawings) via a lead, and the data process unit is configured to process the information acquired by the signal inductor 5. The device for detecting the thickness of a sheet-type medium according to this embodiment is to detect the thickness of the sheet-type medium in a full range, and the number of the floating support frames 31 provided therein is twelve groups, and the floating support frames are arranged in parallel in a direction perpendicular to a transferring direction of the sheet-type medium. Apparently, the number of the floating support frame 31 may be increased or decreased according to design requirement, and theoretically, the more, the floating support frames 31 are provided in a scope of certain width, the more accurately, the thickness of the sheet-type medium passing is detected, and the more accurately, the financial apparatus verifies and determines the medium passed.

Preferably, the floating support frame 31 is further provided with a dust scraper 34, a free end of the dust scraper 34 scrapes against a surface of the detection roller 32 to scrape dusts accumulated on the surface of the detection roller 32 during rotation of the detection roller 32.

Figure 3:
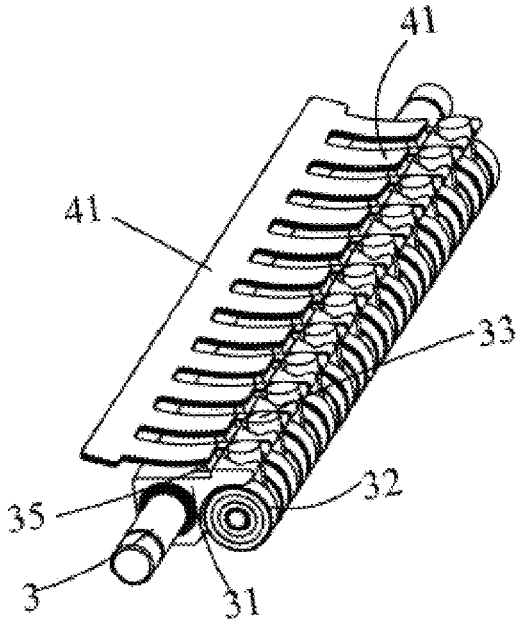
FIG. 3 is a schematic diagram showing the cooperation between an elastic pressing plate and a detection shaft in the device for detecting the thickness of a sheet-type medium as shown in FIG. 1.
Figure 4:
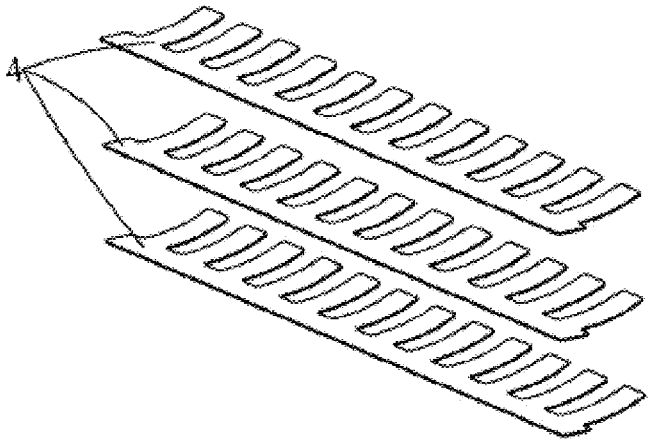
FIG. 4 is a schematic diagram showing the composition of the elastic pressing plate in the device for detecting the thickness of a sheet-type medium as shown in FIG. 1.

Reference is made to FIGS. 3 and 4, for multiple floating support frames 31, the elastic pressing plate 4 is composed of a strip-shaped elastic plate 41, and twelve elastic pressing bars 42 corresponding to the floating support frames are extended from the elastic plate.

Reference is made to FIG. 1, the working principle of the device for detecting the thickness of a sheet-type medium is briefly introduced. The sheet-type medium P to be detected is transferred at a high speed between the reference roller 21 and the detection roller 32, and due to a pressing action of the medium P, in a case that the reference roller 21 is not displaced, the detection roller 32 is pressed to be away from the reference roller 21. Since the detection roller 32 is installed at a free end of the floating support frame 31, the floating support frame 31 rotates anticlockwise about the detection shaft 3, and as the floating support frame 31 rotates, the signal generator 33 also rotates along with the rotation of the floating support frame 31 and is thereby lifted. If the distance between the signal generator 33 and the signal inductor 5 varies, the data process unit which is electrically coupled to the signal inductor 5 calculates thickness value of the sheet-type medium passed by means of the variation of the signal detected by the signal inductor 5.

Figure 5:
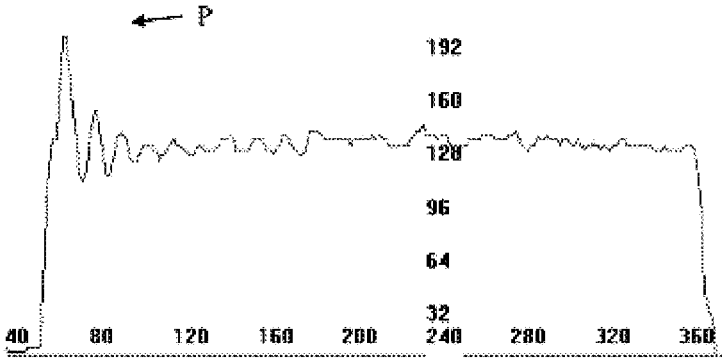
FIG. 5 is a waveform diagram of a signal acquired from the device for detecting the thickness of a sheet-type medium as shown in FIG. 1 with the elastic pressing plate being a single sheet.

The sheet-type medium to be detected is transferred at a very high speed, thus when a front end of the sheet-type medium enters between the reference roller 31 and the detection roller 32 at a high speed, the components of the detection roller may be caused to shake mechanically. Such a mechanical shaking, as reflected in the output signal of the signal inductor 5, results in a peak P at an initial part of the output signal and causes an attenuation oscillation of the signal, and the time for regulating the oscillation prolongs as the running speed of the banknote increases. As seen from the waveform diagram of a signal acquired with the elastic pressing plate composed of a single sheet shown in FIG. 5, if the time for regulating the oscillation is too long, the accuracy in detecting the thickness value of the sheet-type medium may be adversely affected.

Figure 6:
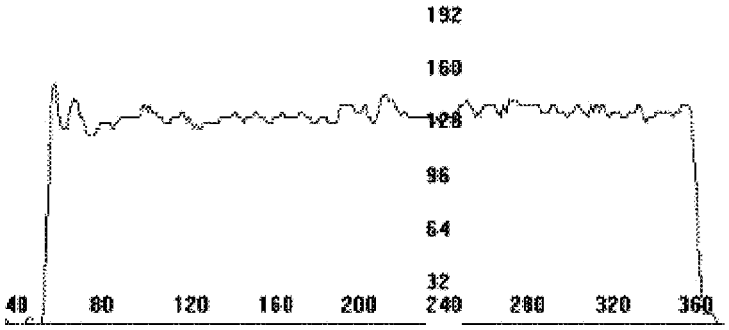
FIG. 6 is a waveform diagram of a signal acquired from the device for detecting the thickness of a sheet-type medium as shown in FIG. 1 with the elastic pressing plate being stacked three sheets.

For reducing the impact, and shortening the time for regulating the oscillation, damping is considered to be added to the system. Specifically, in a case that the pressing force between the reference roller 21 and the detection roller 32 keeps unchanged, the single piece of elastic pressing plate is replaced by stacked three pieces of elastic pressing plates to press the floating support frame, and the system damping is provided by utilizing the friction between the elastic sheets, thus reducing the impact peak value of the output signal caused at the instant when the front end of the sheet-type medium rushes at a certain speed to a point at which the reference roller 21 engages with the detection roller 32, and shortening the time for regulating the oscillation of the output signal. As seen from the waveform diagram of the signal acquired shown in FIG. 6, after being improved by using the technology according to the present application, the device for detecting the thickness of a sheet-type medium has effectively addressed the issue of the peak occurred at the initial part of the signal, which effectively ensures the accurateness and reliability of the detection device.

The above description is only preferred embodiments of the present application. It should be noted that, the above preferred embodiments are not intended to limit the present application, and the protection scope of the present application is defined by the claims of the present application. For the person skilled in the art, many modifications and improvements may be made to the present application without departing from the principle of the present application, and these modifications and improvements are also deemed to fall into the protection scope of the present application.

The invention claimed is:

1. A device for detecting the thickness of a sheet-type medium, comprising:

a fixing frame configured to support and install the following components;

a reference shaft having two ends installed onto the fixing frame through bearings, and receiving a power as an input power source for a sheet-type medium, with a reference roller being fixedly fitted on the reference shaft;

a detection shaft having two ends fixedly installed onto the fixing frame, the detection shaft being provided thereon with at least one floating support frame which has one end capable of rotating freely about the detection shaft, and a detection roller being freely rotatable and provided on a free end of the floating support frame, and a signal generator being fixedly provided at the free end of the floating support frame on a side opposite to the detection roller, with the detection roller being arranged in elastic contact with the reference roller;

an elastic pressing plate having one end fixed to the fixing frame and the other end forming a free end and applying a pressing force to the floating support frame in a direction towards the reference roller; and a signal inductor arranged on the floating support frame and corresponding to the signal generator, wherein the elastic pressing plate is composed of at least stacked two elastic sheets and the elastic sheets have one end relatively fixed and the other end forming a freely stacked state; the number of the floating support frames is twelve groups, the elastic pressing plate is a strip-shaped elastic plate, and twelve elastic pressing bars corresponding to the floating support frames are extended from the elastic plate.

2. The device for detecting the thickness of a sheet-type medium according to claim 1, wherein the floating support frame is further provided with a dust scraper, a free end of the dust scraper scrapes against a surface of the detection roller to scrape dusts accumulated on the surface of the detection roller during rotation of the detection roller.

* * * * *